US006102479A

United States Patent [19]

Wallace

[11] Patent Number: 6,102,479

[45] Date of Patent: Aug. 15, 2000

[54] LOCKING PIVOT CONNECTION FOR COT-CHAIR

[76] Inventor: William J. Wallace, 5221 Washington Road, Hampton, Ontario, Canada, L0B 1J0

[21] Appl. No.: 09/273,469

[22] Filed: Mar. 22, 1999

[51] Int. Cl.[7] ..... A47C 4/44; A47C 5/10; B60N 2/22

[52] U.S. Cl. ..... 297/357; 297/184.15; 297/16.1; 403/93; 403/59; 5/634; 5/113; 5/111; 16/235

[58] Field of Search ..... 297/16.1, 16.2, 297/900, 184.15, 5.11, 357; 403/93, 96, 59, 61; 5/633, 634, 113, 111; 16/235

[56] References Cited

U.S. PATENT DOCUMENTS

| | | | |
|---|---|---|---|
| 829,589 | 8/1906 | Leavitt | 5/113 X |
| 831,517 | 9/1906 | Michaud | 5/634 |
| 998,996 | 7/1911 | Swenson et al. | 5/634 |
| 1,181,491 | 5/1916 | Sutcliffe | 403/93 |
| 2,591,551 | 4/1952 | Kaplan . | |
| 3,897,102 | 7/1975 | Lemaire | 297/900 X |
| 5,520,141 | 5/1996 | Lutz | 403/93 X |

FOREIGN PATENT DOCUMENTS

| | | | |
|---|---|---|---|
| 104792 | 8/1938 | Australia | 297/184.15 |
| 1230706 | 12/1987 | Canada . | |
| 2405391 | 9/1974 | Germany | 297/184.15 |
| 197809 | 9/1978 | Germany | 297/16.2 |
| 486264 | 1/1955 | Italy | 5/634 |
| 25125 | 11/1909 | United Kingdom | 5/113 |

*Primary Examiner*—Peter M. Cuomo
*Assistant Examiner*—David E. Allred
*Attorney, Agent, or Firm*—Arne I. Fors

[57] ABSTRACT

A locking pivot connector for a cot-chair back rest and a swivel joint for a sun shade supported by the back rest are disclosed. The locking pivot connector permits longitudinal placement of the back rest on the cot-chair with selective angular adjustment of the back rest on the cot-chair to allow its use as a cot, chair or chaise lounge. The sun shade swivel connection permits almost 360° angular rotation of the sun shade by a spring-loaded ratchet assembly.

3 Claims, 7 Drawing Sheets

72
180
176
158
160
177
150
152
154
156
11
144
143
140
142
146
141
148
145

72
174
6
180
176
158
170
162
150
168
172
142
148
6
140
11

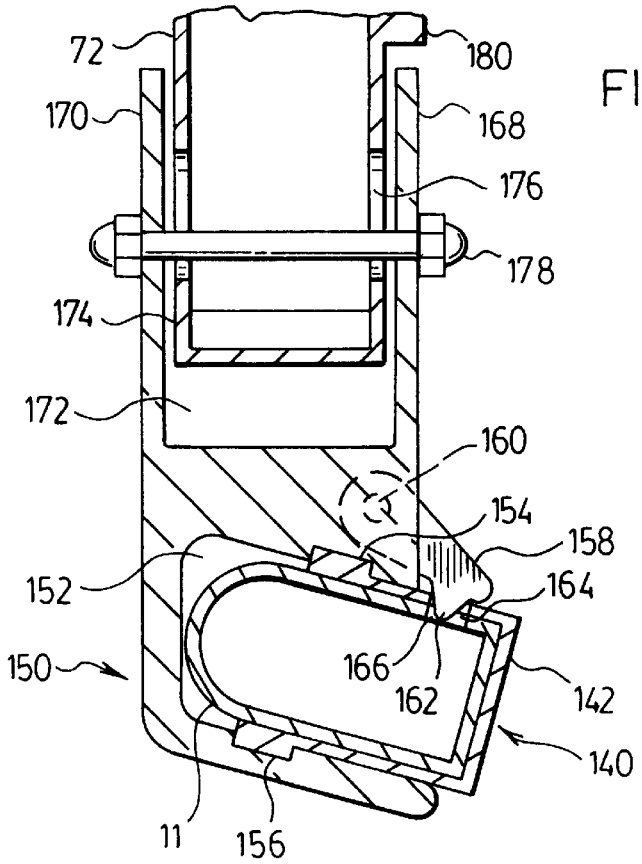
FIG.6.
FIG.7.
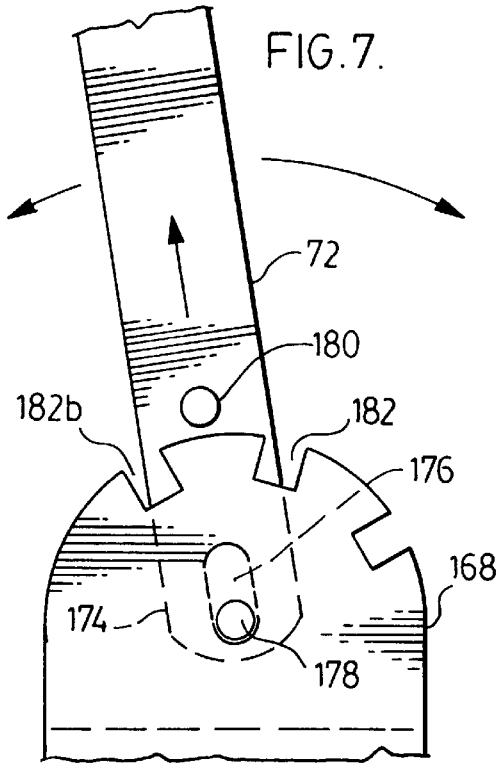
FIG.8.
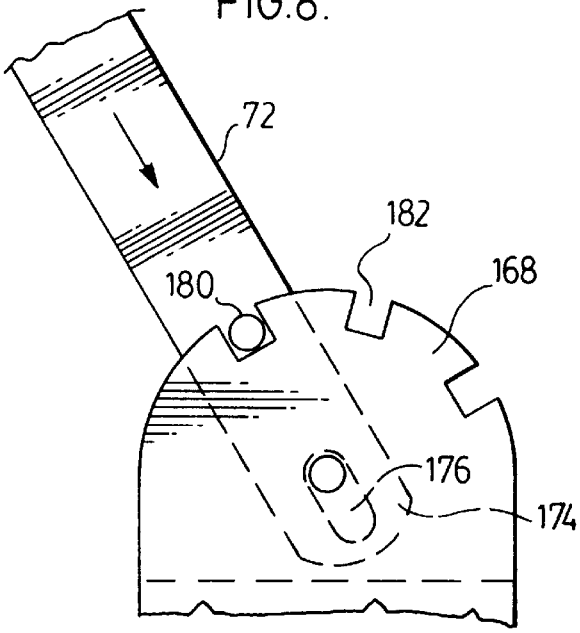

LOCKING PIVOT CONNECTION FOR COT-CHAIR

BACKGROUND OF THE INVENTION (i) Field of the Invention

This invention relates to a folding cot-chair and, more particularly, relates to a folding cot-chair having a reversible back rest and a pivotal sun shade capable, of being folded into a compact bundle.

(ii) Description of the Related Art

U.S. Pat. No. 2,591,551 discloses a cot having side rails and end rails hinged at their respective centres to permit folding of the cot into a bundle. The folding end rails, each comprising two co-axial sections hinged together at their adjacent ends and having means connecting the opposite ends of the end rails to side rails for multiple movement about three different axes for collapse of the cot, render the cot structure difficult to fold, or unfold, while making the assemblage bulky when collapsed.

Canadian Patent No. 1,230,706 relates to a folding cot-chair which can be readily configured as a cot, a chair or a chaise lounge and which can be easily disassembled and formed into a compact bundle for portability and storage, the description of which is incorporated herein by reference.

The present invention is directed to an improved cot-chair having a novel back-rest pivotal connection and sun shade pivotal connection which permit facile adjustment into a plurality of positions.

SUMMARY OF THE INVENTION

The folding cot-chair of my invention comprises, in its broad aspect, a pair of side rails, each side rail formed of two axially aligned tubular members centrally hinged together and adapted to be collapsed into a folded position and extended to the axially aligned position, a plurality of pairs of crossed legs pivotally secured to said side rails, means for pivotally securing the legs at each pair to each other at about the centre of the said legs, said means for pivotally securing each pair of legs to each other comprising a generally x-shaped pivotal fitting having sockets formed at the distal ends of the fitting for receiving a portion of the legs whereby each leg is laterally axially offset at the fitting to permit each pair of legs to be pivoted to a folded position such that the legs are disposed parallel to each other, and a body supporting sheet of flexible material secured to the side rails.

A back rest comprises a pair of laterally spaced-apart side rails each of which is pivotally connected to a connector bar having means for removably securing said connector bar to the side rails of the cot-chair and having means for locking the side rails in a selected position. A sun shade is pivotally mounted above the upper end of the back rest and can be adjusted through about 360° of rotation to provide shade for the user of the unit. The back rest can be reversed to provide either a chair or a chaise lounge.

BRIEF DESCRIPTION OF THE DRAWINGS

The invention will now be described in detail with reference to the accompanying drawings, in which:

FIG. 6 is a sectional view of the locking pivot means taken along line 6—6 in FIG. 5;

FIG. 7 is a side elevation showing the locking pivot means in its released position;

FIG. 8 is a side elevation showing the locking pivot means in an operative locked position;

DESCRIPTION OF THE PREFERRED EMBODIMENT

Figure 1:
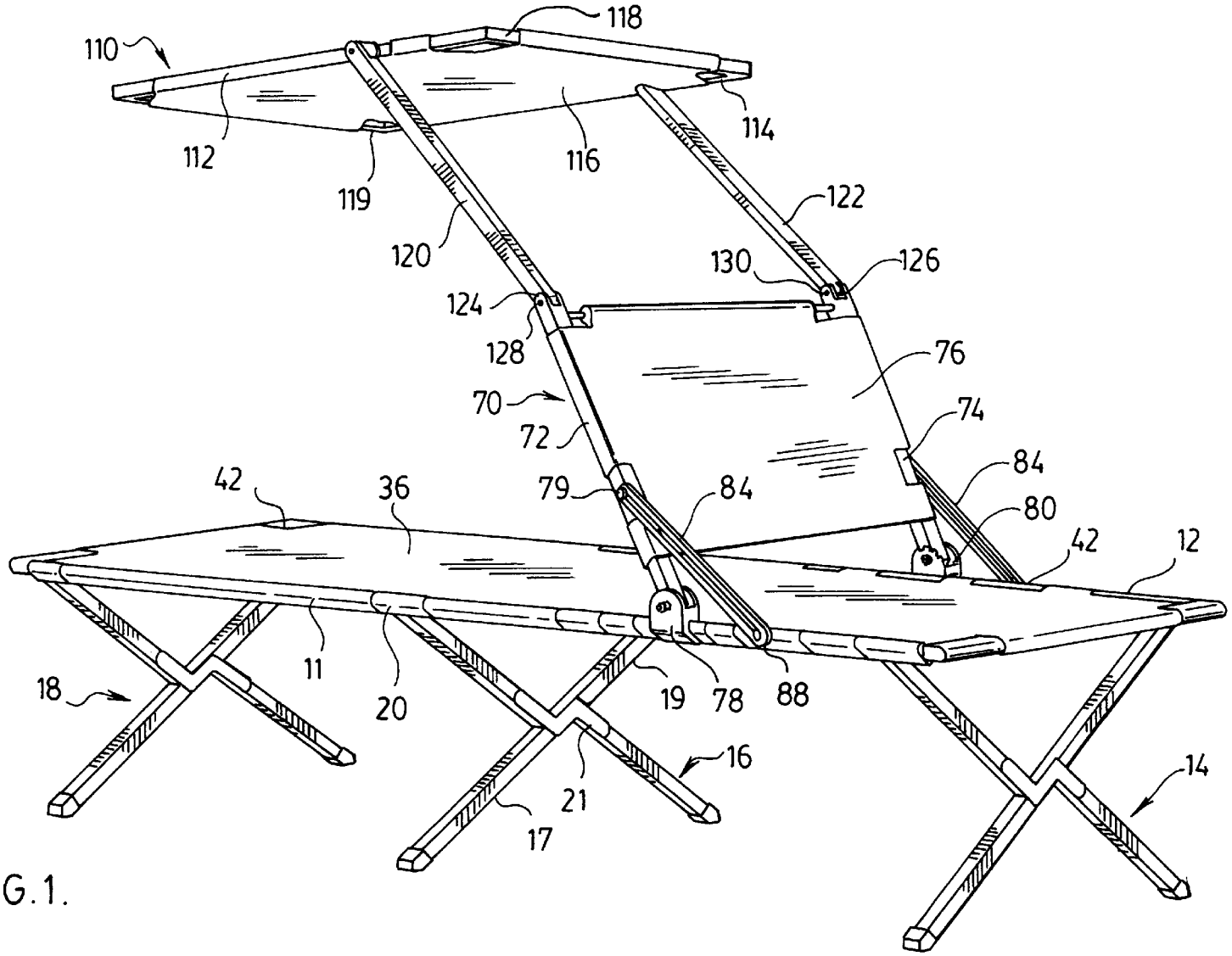
FIG. 1 is a perspective view of the chair-cot of the invention shown in an operative position as a chair and cot.
Figure 2:
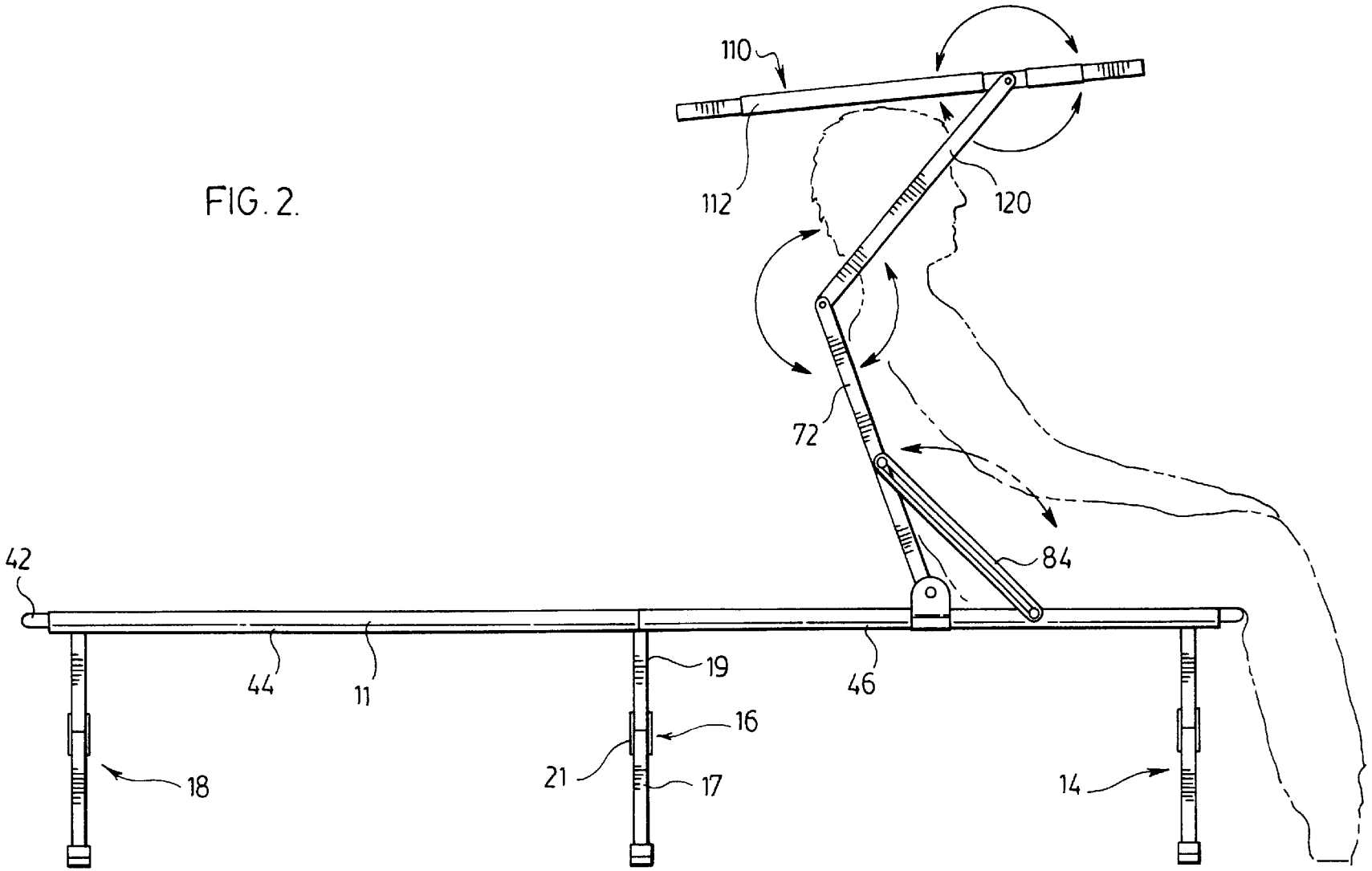
FIG. 2 is a schematic side elevation corresponding with FIG. 1 with adjustment of the sun shade.
Figure 3:
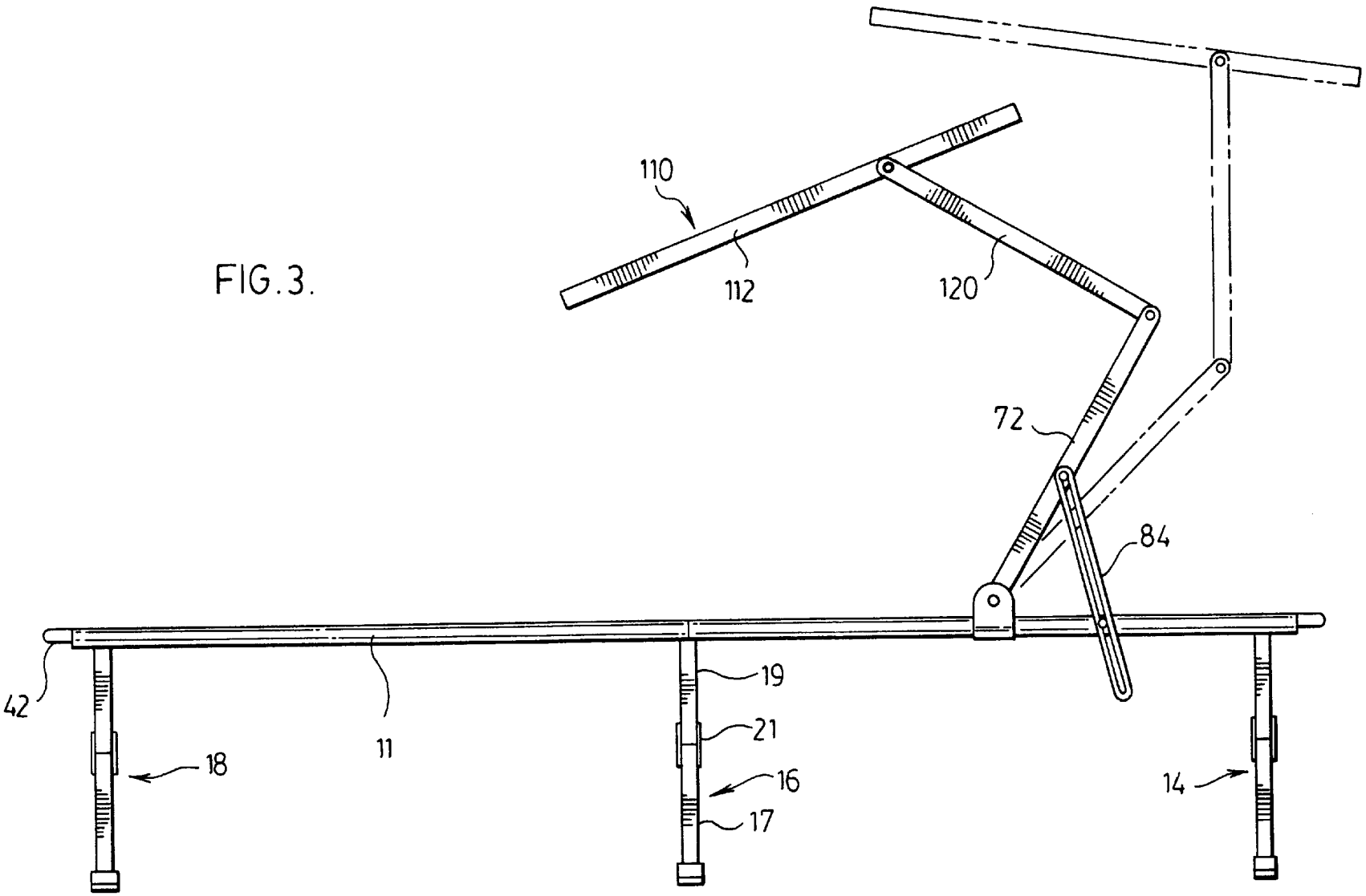
FIG. 3 is a schematic side elevation of the configuration as a chaise lounge.
Figure 4:
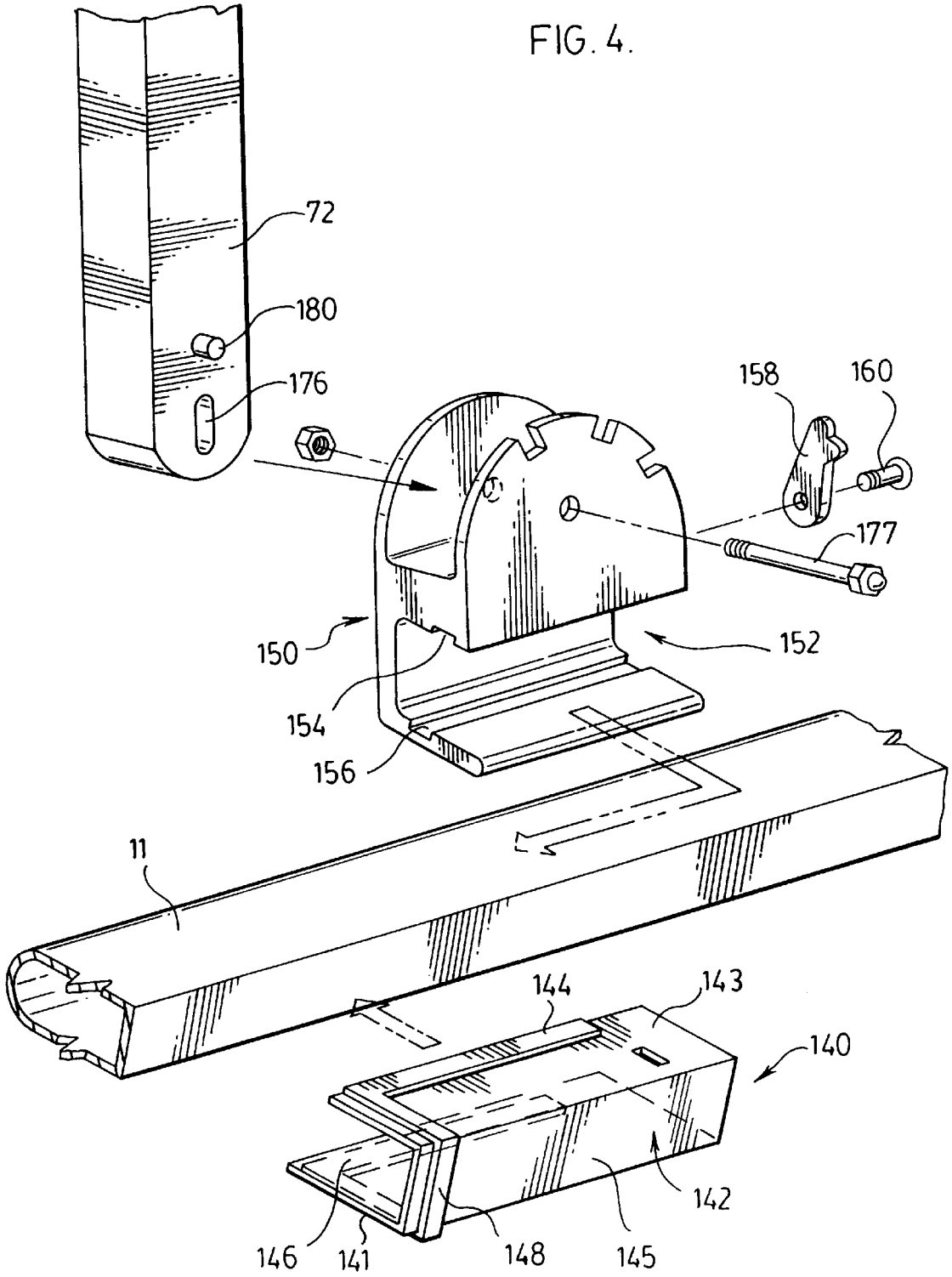
FIG. 4 is an exploded perspective view of the locking pivot means of the invention.
Figure 5:
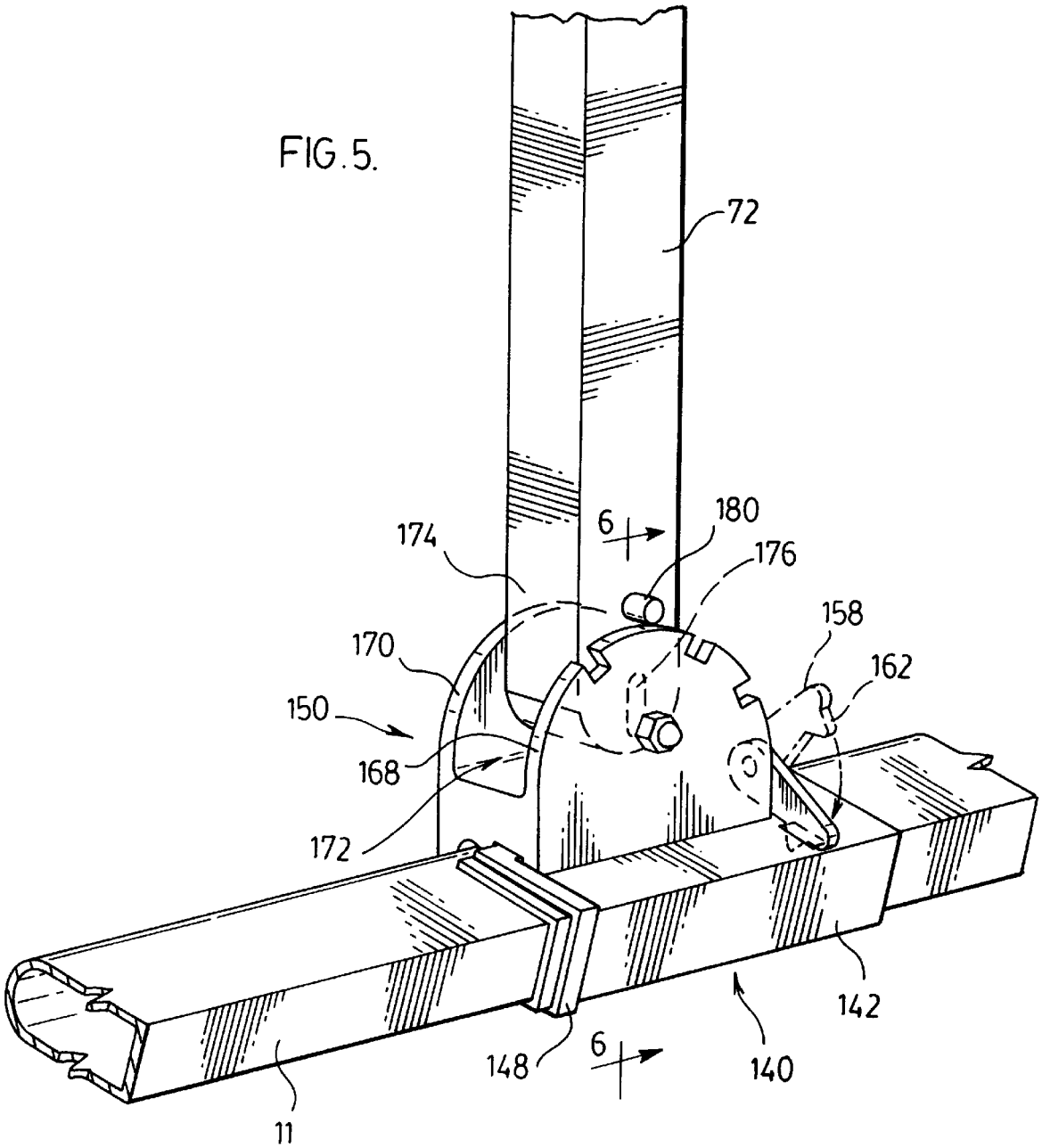
FIG. 5 is a perspective view of the locking pivot means shown in FIG. 4 in its assembled form mounted on a side rail at the cot-chair.

With reference to FIGS. 1–3, the cot portion of the cot-chair assembly comprises a main frame having a pair of side rails 11, 12 with at least two pairs, and preferably three pairs, of spaced-apart crossed legs depicted by numerals 14, 16 and 18 pivotally connected to side rails 11, 12 by means of pivotal connectors 20. Connectors 20 are well-known in the art and enable each pair of legs 14, 16 and 18 to be pivoted inwardly upwardly against the side rails as shown in Canadian Patent No. 1,230,706.

The central portion of each pair of legs 14, 16 and 18 includes the connector 21 for pivotally connecting the leg portions 17, 19 of each pair together. Each pivotal connector 21 permits collapse of the legs from their open, operative position as shown in FIG. 1, with the arrows indicating the relative direction of pivotal movement of the legs for collapse into their closed position.

The maximum opening of each pair of legs 14, 16 or 18 is limited by the width of flexible sheet 36, such as canvas or flexible plastic, secured to side rails 10, 12 such as by lacing of canvas or by heat and pressure welding of flexible plastic. Appropriate cut-outs 42, FIG. 1, are located at the several pivot points and connections along the frame.

Each of side rails 10, 12 preferably is formed of two sections 44, 46 normally arranged in end-to-end co-axial alignment in the operative position of the cot, FIG. 1, and pivotally connected at their adjacent extremities by a pair of connectors for folding. Each of connectors 21 comprises a central bight portion wrapped around an adjacent end of side rail components and secured thereto such as by rivets.

The back rest 70 comprising a pair of side rails 72, 74 having a sheet of flexible material 76 secured thereto such as by a conventional hem are attached to cot side rails 11, 12 by locking connector means 78, 80 of the invention, to be described. Back rest 70 can be positioned in a plurality of configurations by the locking pivot means and optionally by braces 84 pivotally mounted on connector pin 79 and slidably secured to side rails 11, 12 by means of threaded bolts 88 passing through side rails 11, 12, one of which is shown, and locked by wing nuts, not shown.

A rectangular sun shade 110 having side rails 112, 114 and end rails 118, 119 with a flexible fabric 116 stretched therebetween is secured at opposite sides to side rail extensions 120, 122 by means of pivot means 124, to be described. Rail extensions 120, 122 are pivotally connected to the upper distal ends of side rails 72, 74 of back rest 70 by means of a pair of double links 124, 126 and secured thereto by wing nut-bolts 128 and 130. Sun shade 116 thus can be readily positioned as desired over the cot to shield the user, as illustrated in FIGS. 1–3.

With reference now to FIGS. 4–8, the locking pivot connectors 78, 80 of the invention comprise a U-shaped bracket 142 having a pair of opposed side walls 141, 143 joined by a web 145 with upper and lower longitudinal keys 144, 146 respectively joined by a transverse section 148. Bracket 142 is slidably fitted onto rail 11 for longitudinal travel thereon. Cast aluminum fitting 150 has side recess 152 with upper and lower keyways 154, 156 respectively for receiving keys 144, 146 therein for assembly on bracket 142 to engage rail 11 for longitudinal travel thereon. A locking detent 158 pivotally mounted such as by rivet 160 on fitting 150 has tab 162 adapted to engage a slot 164 in bracket 142 which can be aligned with a corresponding slot 166 of a plurality of equispaced slots in side rail 11 to lock the bracket thereon at a desired longitudinal position.

A pair of spaced-apart, upstanding, semi-circular lobes 168, 170 of fitting 150 define a recess 172 for receiving therein the rounded proximal end 174 of a side rail 72 of back rest 76. A longitudinal elongated slot 176 formed in end 174 to receive bolt 177 of nut and bolt assembly 178 allows longitudinal reciprocal movement of the side rail for upward axial retraction of side rail 72 to release detent pin 180 (FIGS. 6 and 7) from a peripheral recess 182 and allow pivotal movement of rail 72 to a desired radial position. Downward axial insertion of detent pin 180 into a peripheral recess such as recess 182*b* (FIG. 8) locks rail 72, and rail 74 in like manner, on cot side rails 11, 12.

Each of pivot connector means 78, 80 is released concurrently by an upward movement of back rest 70 and locked concurrently by a downward movement thereof in the desired new angular location. Brace 84 can optionally be locked to ensure back rest 70 is fixed in its desired configuration.

Figures 9, 10:
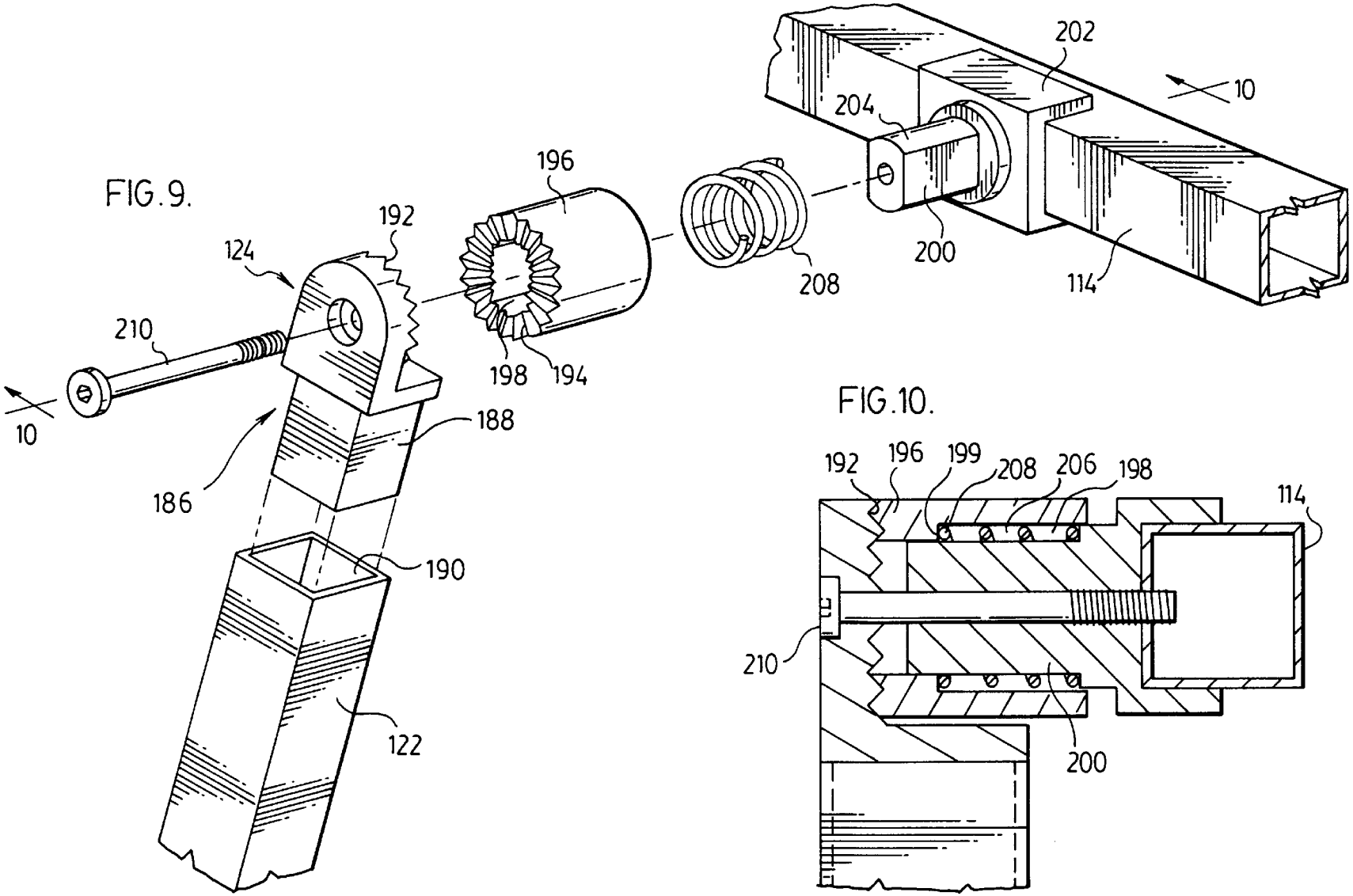
FIG. 9 is an exploded perspective view of the sun shade pivot means of the invention.
FIG. 10 is a longitudinal section along line 10—10 of FIG. 9.

Turning now to FIGS. 9 and 12, sun shade 110 is pivotally secured to the distal ends of side rail extensions 120, 122 by a locking pivot means 124 comprising an aluminum casting 186 having a stub extension 188 which fits into socket 190 of rail extension 122 and a circular ratchet surface 192 which abuts mating circular ratchet surface 194 of nylon cylinder 196. Cylinder 196 has a longitudinal cylindrical cavity 198 with a rectangular cross-section defining internal shoulder 199 at one end to receive therein rectangular extension 200 of bracket 202 which is screwed or rivetted onto rail 114. Extension 200 has rounded side faces 204 which define with the interior of cavity 198 an annulus 206 for receiving compression spring 208 for biasing extension 200 axially away from cylinder 196.

In use, side rails 112, 114 of the sun shade 110 are pivoted to the desired position and screws 210 threaded into the side rails 112,114 (FIG. 10) are tightened to compress springs 208 to urge ratchet face 194 of cylinder 196 against mating ratchet face 192 of fitting 186. Sun shade 110 can be further pivoted by hand without releasing screws 210, inner ratchet face 194 of cylinder 196 being displaced to the right as viewed in FIG. 10, under the bias of compression spring 208.

The frame and leg components preferably are formed of extruded aluminium tubing and the connectors, linkage and the like formed of aluminium alloy castings.

The assembly is light in weight and can be folded into a compact bundle 36 inches long with a 6 inch diameter.

It will be understood that modifications can be made in the embodiment of the invention illustrated and described herein without departing from the scope and purview of the invention as defined by the appended claims.

I claim:

1. A locking pivot connector for a cot-chair having a pair of cot side rails and a back rest having back rest side rails, for pivotally connecting each back rest side rail to a respective cot side rail comprising a U-shaped bracket having a pair of opposed side walls joined by a web and adapted for slidable travel on a cot side rail, a key formed longitudinally on an exterior surface of each side wall, a cast metal fitting having a side recess with opposed keyways for receiving the side wall keys therein whereby the fitting can be assembled on the bracket to straddle one of the cot side rails for slidable travel thereon with the bracket, detent means for engaging said one of the cot side rails to lock the fitting on said one of the cot side rails, a pair of spaced-apart semi-circular lobes extending upwardly from the fitting defining a recess for receiving an end of one of the back rest side rails therein, said end of said one of the back rest side rails having a longitudinal slot formed therein, pivot means extending between the semi-circular lobes and through the longitudinal slot whereby the back rest rail can be pivoted on said pivot means and reciprocated longitudinally, a plurality of recesses formed on one of said semi-circular lobes, and a detent pin extending from the back rest side rail adapted to be inserted in one of said lobe recesses, whereby the back rest side rail can be retracted to release the detent pin from a lobe recess and extended to engage a lobe recess for angular adjustment of the back rest side rails on the fitting.

2. A folding cot-chair comprising, in combination, a pair of cot side rails, each side rail formed of axially aligned tubular members centrally hinged together and adapted to be collapsed into a folded position and extended to the axially aligned position, a plurality of pairs of crossed legs pivotally secured to said side rails, means of pivotally securing the legs of each pair to each other at about the centre of the said legs, a body supporting sheet of flexible material secured to the side rails, and a back rest having a pair of laterally spaced-apart side rails, a body supporting sheet of flexible material secured to said back rest side rails, a locking pivot connector for pivotally connecting each of said back rest side rails to one of said cot side rails, said locking pivot connector comprising a U-shaped bracket having a pair of opposed side walls joined by a web and adapted for slidable travel on a cot side rail, a key formed longitudinally on an exterior surface of each side wall, a cast metal fitting having a side recess with opposed keyways for receiving the side wall keys therein whereby the fitting can be assembled on the bracket to straddle said one of the cot side rails for slidable travel thereon with the bracket, detent means pivotally mounted on the fitting for engaging said one of the cot side rails to lock the fitting on said one of the cot side rails, a pair of spaced-apart semi-circular lobes extending upwardly from the fitting defining a recess for said one of the back rest side rails, receiving an end of one of the back rest side rails therein, said end of having a longitudinal slot formed therein, pivot means extending between the semi-circular lobes and through the longitudinal slot whereby the back rest rail can be pivoted on said pivot means and reciprocated longitudinally, a plurality of recesses formed on one of said semi-circular lobes, and a detent pin extending from the back rest side rail adapted to be inserted in one of said lobe recesses, whereby the back rest side rail can be retracted to release the detent pin from a lobe recess and extended to engage a lobe recess for angular adjustment of the back rest side rails on the fitting.

3. A locking pin connector as claimed in claim 2 in which the detent means comprise a detent having a tab pivotally mounted on the fitting, and said one of said cot side rails have at least one slot formed therein for receiving the detent tab.

* * * * *